United States Patent [19]

Quillen et al.

[11] Patent Number: 4,639,960

[45] Date of Patent: Feb. 3, 1987

[54] RECLINER FOR MEDICAL CONVALESCENCE

[76] Inventors: Jeffrey B. Quillen, P.O. Box 144, Mooresville, Ind. 46158; James G. Spahn, 4500 Kessler Blvd. East Dr., Indianapolis, Ind. 46220

[21] Appl. No.: 723,818

[22] Filed: Apr. 16, 1985

[51] Int. Cl.[4] ..... A47C 27/10; A61G 7/04

[52] U.S. Cl. ..... 5/455; 5/431; 5/443; 5/465; 5/441; 24/31 F; 24/31 W

[58] Field of Search ..... 5/455, 465, 431, 443, 5/449, 437, 441, 420; 24/31 W, 31 F; 297/DIG. 3

[56] References Cited

U.S. PATENT DOCUMENTS

| | | | |
|---|---|---|---|
| 716,752 | 12/1902 | Phillips | 5/465 |
| 2,612,645 | 10/1952 | Boland | 5/441 |
| 2,834,032 | 5/1958 | Scott | 5/443 |
| 3,112,956 | 12/1963 | Schick et al. | 5/455 |
| 3,333,286 | 8/1967 | Biolik | 5/431 |
| 3,680,917 | 8/1972 | Harris | 297/DIG. 3 |
| 3,789,437 | 2/1974 | Garte | 5/431 |
| 4,163,297 | 8/1979 | Neumark | 5/455 |
| 4,171,549 | 10/1979 | Morrell et al. | 5/465 |
| 4,459,714 | 7/1984 | Lin | 5/441 |
| 4,473,913 | 10/1984 | Ylvisaker | 5/441 |
| 4,484,781 | 4/1985 | Phelps | 5/455 |

FOREIGN PATENT DOCUMENTS

| | | | |
|---|---|---|---|
| 340506 | 12/1930 | United Kingdom | 5/457 |
| 2105984 | 4/1983 | United Kingdom | 5/455 |

*Primary Examiner*—Alexander Grosz

*Attorney, Agent, or Firm*—Woodard, Weikart, Emhardt & Naughton

[57] ABSTRACT

An air inflatable recliner including: a back and head support extending upwardly at angles between 30 and 45 degrees, comprised of 3 individual wedge shaped, air inflatable, cushions interconnected together in a single vertical stack; which back and head support is removably interconnected together with a leg and foot support, comprised of individual wedge shaped, air inflatable, cushions positioned and interconnected together in 2 vertical stacks for elevation of the popliteal fossa through 120 to 150 degrees; and, an air inflatable support for dissipating body heat, which has a plurality of holes extending therethrough, and which is positioned atop said back and head support.

11 Claims, 10 Drawing Figures

RECLINER FOR MEDICAL CONVALESCENCE

BACKGROUND OF THE INVENTION

1. Field of the Invention

The present invention generally relates to the field of reclining devices for supporting the human body, and more particularly, is concerned with an affordable, portable, air inflatable recliner to sit atop a medical patient's bed to provide the correct and most effective medical convalescent postures.

2. Description of the Prior Art

A classic convalescent posture that has been recommended by doctors for decades for its promotion of the healing processes for many medical conditions was defined by American surgeon George Ryerson Fowler at the turn of this century. It is known as the "Fowler position." In the Fowler position the medical patient is reclining in bed in a supine posture with the head of the patient's bed raised 18 to 20 inches above the level, and the knees also elevated. This basic configuration of body support has been adopted and utilized in medical practice because of its inherent physiological convalescent properties resulting from the effective use of gravitational forces, and because it has proven to be an anatomically correct posture as evidenced by its long-term comfort.

For these reasons, most convalescence in medical practice is pescribed to be accomplished in a Fowler position. More particularly, the configurations of body support that have long been known and prescribed by doctors because of their inherent convalescent properties are presented in FIG. 9 ("Prior Art"), representing the basic Fowler position, and FIG. 10 ("Prior Art"), representing the modified Fowler position. Embodiments of these basic configurations of body support can be found in adjustable hospital beds, but as medical costs have risen, a definite trend toward minimizing hospital convalescence in favor of convalescence outside the hospital has been observed. Even minor surgery is now being accomplished on an outpatient basis. However, no satisfactory, air inflatable alternative to the adjustable hospital-style bed was available for utilization in convalescent care in the patient's home, or at intermediate care facilities such as nursing homes, for example. The present invention provides an affordable, portable, air inflatable recliner to rest atop a medical patient's bed to provide the correct and effective medical convalescent postures represented by the basic or modified Fowler position.

Various forms of reclining devices that support the human body in the basic and modified Fowler positions depicted in FIGS. 9 and 10 have been proposed in the prior art. These Fowler positions have been generally embodied not only in hospital beds but also in surgical tables, dentist chairs, lounge chairs, beach chairs, and furniture recliners of numerous types. However, such embodiments of the Fowler position are not suitable for affordable and easily portable home or secondary care facility convalescent care or do not provide the correct and effective medical convalescent postures depicted in FIGS. 9 and 10.

Patent references known to the inventors that may be relevant include the following:

| Patent No. | Patentee |
|---|---|
| 4,473,913 | Ylvisaker |
| 4,171,549 | Morrell et al. |
| 3,680,917 | Harris |
| 2,612,645 | Boland |

In the Ylvisaker reference there is disclosed a three-pillowed therapeutic support cushion composed, in part, of two end pillows that when spaced apart will, in cooperation with a horizontal surface, support a person in a supine posture in a Fowler-type position. The three-pillowed therapeutic support cushion of Ylvisaker is principally designed for convalescence in a face-down prone position to situate a person so that the spine is in a forwardly curving and relaxed posture. By virtue of the end pillow design necessary to accommodate a person in the primary face-down prone position the use of the end pillows to support a person in a supine posture in a Fowler-type position as taught by Ylvisaker does not result in the correct and effective medical convalescent postures of the basic or modified Fowler positions depicted in FIGS. 9 and 10, which are provided by the instant invention. In the Ylvisaker construction, the end pillows are always of identical construction, being mirror images of one another. While the Ylvisaker end pillows would provide support of the legs and upper torso in a Fowler-type supine position if positioned in the manner taught, these pillows would not position the person in an anatomically and physiologically correct manner. The human body does not measure the same from the coccyx (the tip of the spine) to the popliteal fossa (the area immediately behind the knees) as it does from the coccyx to the top of the head, the latter always being of greater measure. The natural and medically correct anatomical and physiological breaking point of the human body between the legs and the torso is at the waist, and not at any point between the coccyx and the top of the head. For the body to break at the waist and at the popliteal fossa, pillows with differing support surface lengths will be required. The support surface between the coccyx and the top of the head would necessarily be longer than the support surface between the coccyx and the popliteal fossa. The Ylvisaker construction results in a break point between the coccyx and the top of the head, and if adjusted to provide a break point at the waist would result in either the head and body not being fully supported or in the popliteal fossa not being properly supported. Furthermore, even though the Ylvisaker construction provides for air inflatability of the end pillows to be used in the supine support mode, there is not the same capability of precisely varying the degree of elevation of the torso for varying medical convalescent needs that is provided in the present invention. Furthermore, the Ylvisaker construction does not provide the structural integrity of the present invention as, for example, the Ylvisaker end pillows are not secured together in any of the possible arrangements, making this construction unsuitable for accommodating the nocturnal kinetics of the convalescing patient, such as when the sleeping patient would toss or roll over onto one side or the other. This kineses causes the patient to slide down hill, so to speak, such that the body conformation is medically unacceptable. The instant invention, by virtue of its interconnected lower body support system, prevents such down hill sliding. The present invention provides support surfaces that resist the longitudinal kinetics of the unconscious patient by the nature of their construction. The support surfaces for the back and head and the leg and foot of the present invention are interconnected together to prevent their relative displacement, thereby providing resistance to body movement that would necessitate relative displacement to any degree of these surfaces.

In the Boland reference there is disclosed a reclining air cushion with an attached apron to be situated under a person to secure the cushion in place. In the Morrell reference there is disclosed a cushion ensemble that may be arranged in various ways to provide various body postures. In the Harris reference there is disclosed an inflatable, ribbed floor rest. Neither the Boland, the Morrell, or the Harris construction embody the efficient and medically correct Fowler positions depicted in FIG. 9 or 10, as does the present invention, nor are such references suitable for accommodating the nocturnal kinetics of the convalescing patient, as is the present invention.

In contrast to the human body supports of the prior art, the present invention provides for the first time a portable, air inflatable recliner to rest atop a patient's bed to support the patient in the correct and effective medical convalescent postures of a basic or modified Fowler position and which is suitable for accommodating the nocturnal kinetics of the convalescing patient.

SUMMARY OF THE INVENTION

One embodiment of the present invention is a back and head support extending upwardly at an angle between 30 degrees and 45 degrees and including a plurality of individual wedge shaped, air inflatable, cushions with a support surface of a first length equal to at least the distance between the coccyx and the top of the head and positioned and interconnected together in a vertical stack; a leg and foot support extending upwardly at a first angle between 20 degrees and 30 degrees and for elevation of the popliteal fossa through a second angle between 120 degrees and 150 degrees and including a plurality of individual wedge shaped, air inflatable, cushions with a support surface of a second length equal to the distance between the coccyx and the popliteal fossa and positioned and interconnected together in vertical stacks; air means on said cushions operable to allow inflation of each at a desired internal air pressure to determine said angles; and, connecting means interconnecting said back and head support and said leg and foot support together, including interconnecting said cushions of said leg and foot support together.

Another embodiment of the present invention is an air inflatable support for dissipating heat from a person positioned thereatop comprising a pair of plastic sheets joined together forming an air pressurizable chamber therebetween, said sheets having a plurality of aligned holes extending therethrough with said sheets being joined together around the circumference of each hole allowing heat flow through said sheets from said person but limiting air flow from said chamber into each hole providing an insulated cushion for said person laying thereatop; and further comprising a back and head support extending upwardly at an angle between 30 degrees and 45 degrees and including a plurality of individual wedge shaped, air inflatable, cushions with a support surface of a first length equal to at least the distance between the coccyx and the top of the head and positioned and interconnected together in a vertical stack; a leg and foot support extending upwardly at a first angle between 20 degrees and 30 degrees and for elevation of the popliteal fossa through a second angle between 120 degrees and 150 degrees and including a plurality of individual wedge shaped, air inflatable, cushions with a support surface of a second length equal to the distance between the coccyx and the popliteal fossa and positioned and interconnected together in vertical stacks; air means on said cushions operable to allow inflation of each at a desired internal air pressure to determine said angles; and, connecting means interconnecting said back and head support and said leg and foot support and said heat dissipating support together, including interconnecting said cushions of said leg and foot support together.

Another embodiment of the present invention is a back and head support extending upwardly at an angle between 30 degrees and 45 degrees and including an air inflatable cushion with a first support surface of a first length equal to at least the distance between the coccyx and the top of the head; a leg and foot support extending upwardly at a first angle between 20 degrees and 30 degrees and for elevation of the popliteal fossa through a second angle of between 120 degrees and at least 140 degrees and including a plurality of air inflatable cushions positioned and interconnected together with a second support surface of a second length equal to the distance between the coccyx and the popliteal fossa and a third support surface of a third length equal to at least said second length; air means on said cushions operable to allow inflation at a desired internal air pressure to determine said angles; and, connecting means interconnecting said back and head support and said leg and foot support together.

Another embodiment of the present invention is a back and head support extending upwardly at an angle between 30 degrees and 45 degrees and including a plurality of individually shaped, air inflatable, cushions positioned and interconnected together with a first support surface of a first length equal to at least the distance between the coccyx and the top of the head; a leg and foot support extending upwardly at a first angle between 20 degrees and 30 degrees and for elevation of the popliteal fossa through a second angle between 120 degrees and 150 degrees and including a plurality of individually shaped, air inflatable, cushions positioned and interconnected together with a second support surface of a second length equal to the distance between the coccyx and the popliteal fossa and a third support surface of a third length equal to at least said second length; air means on said cushions operable to allow inflation at a desired internal air pressure to determine said angles; and, connecting means interconnecting said back and head support and said leg and foot support together.

It is an object of the present invention to provide a recliner for convalescent use that provides the correct and effective medical convalescing postures most often prescribed for convalescing patients, depicted in FIGS. 9 and 10.

It is a further object of the present invention to provide a recliner for convalescent use that is completely air inflatable, permitting compact packaging in its deflated state for ease of storage, distribution and transportation.

It is a further object of the present invention to provide recliner cushions having a plurality of internal air chambers in fluid communication together to delay deflation of each cushion in the event of accidental rupture at any point.

It is a further object of the present invention to provide a recliner for convalescent use that can be made available at an affordable cost to needy patients.

Related objects and advantages of the present invention will be apparent from the following descriptions.

DESCRIPTION OF THE PREFERRED EMBODIMENTS

Figure 1:
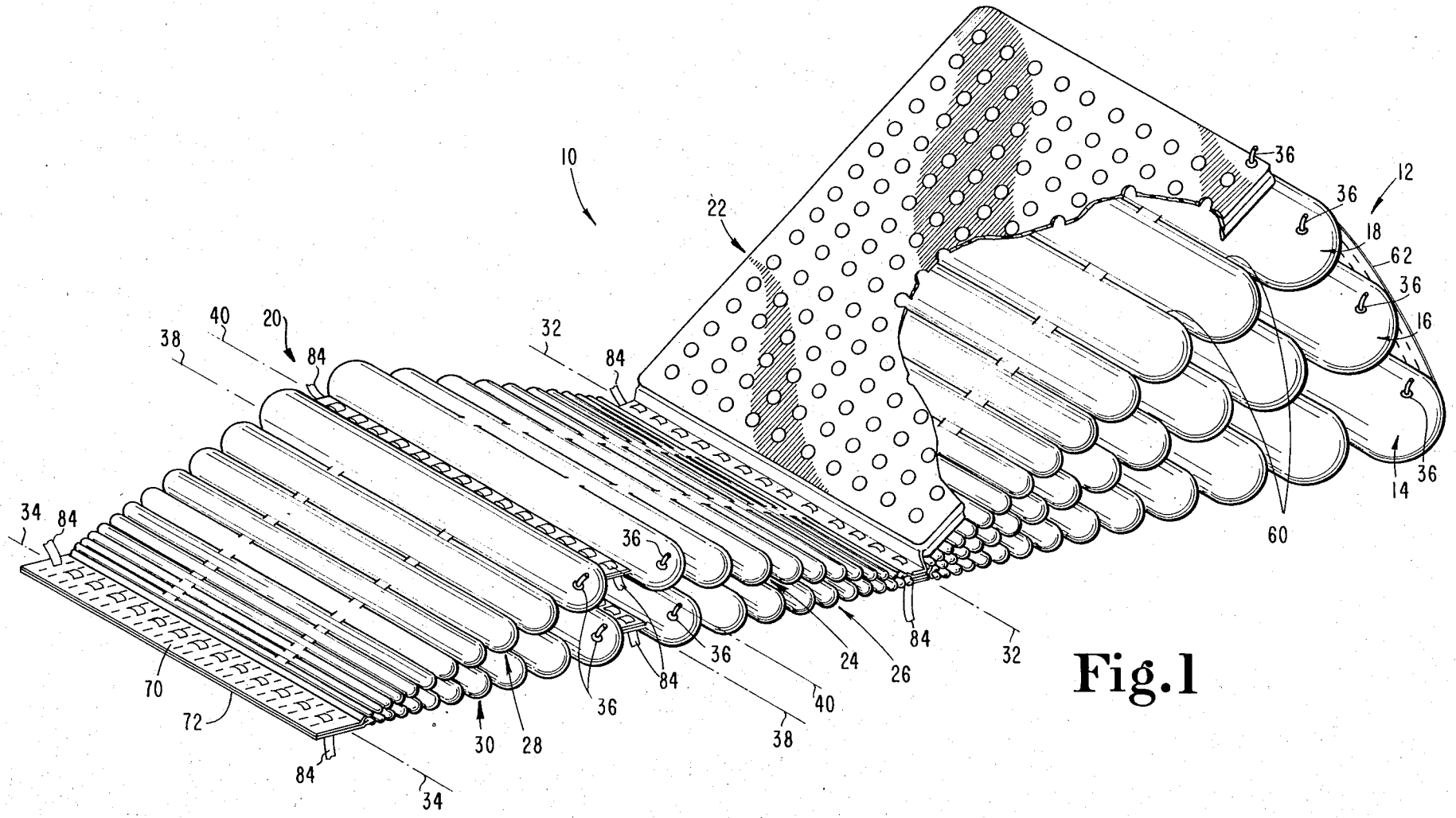
FIG. 1 is a perspective and partially segmented view of the recliner that is the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles and theory of the invention therein being contemplated as would normally occur to one skilled in the art to which the invention relates.

Referring now to the drawings, there is shown in FIG. 1 a preferred embodiment of the recliner 10 of the present invention. This preferred embodiment is composed of the back and head support 12, shown in FIG. 1 at its full-inflation upward angle of 45 degrees, composed of three individual wedge shaped, air inflatable cushions 14, 16, and 18, positioned and interconnected together in a vertical stack. The back and head support 12 is interconnected along line 32—32 with the leg and foot support 20, shown in FIG. 1 at full-inflation in the configuration for elevation of the popliteal fossa through 120 degrees. The leg and foot support 20 is composed of four individual wedge shaped, air inflatable cushions 24, 26, 28, and 30, that are positioned and interconnected together by connecting means along lines 32—32, 34—34, 38—38, and 40—40. The air inflatable support 22 for dissipating heat is shown in FIG. 1 in fragment and at full-inflation, interconnected together by connecting means with the back and head support 12 and the leg and foot support 20 along line 32—32.

Each of the individual wedge shaped, air inflatable, cushions 14, 16, 18, 24, 26, 28, and 30 comprising the back and head support 12 and the leg and foot support 20 have conventional air inflation means 36 (valve), permitting separable inflation of the individual cushions to desired air pressures. Likewise, the support 22 for dissipating heat has a conventional air inflation means 36, permitting its separable inflation to variable air pressures.

Figure 5:
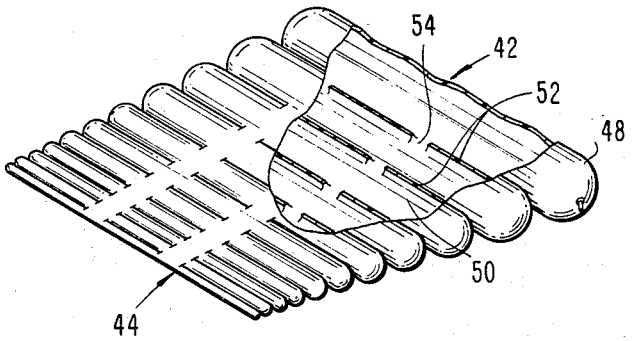
FIG. 5 is a perspective partially segmented view of an individual wedge shaped, air inflatable, cushion of FIG. 1, and without connecting means attached.

Each of the individual wedge shaped, air inflatable, cushions 14, 16, 18, 24, 26, 28, and 30 comprising the back and head support 12 and the leg and foot support 20 are identical in general shape and construction. Referring to FIG. 5, there is shown a perspective partially segmented view of one such cushion, but without connecting means attached. Each cushion is comprised of adjacent compartments, cylindrical in configuration with spherical caps, that are in side-by-side relationship, each compartment being of constant cylindrical radius, with the cylindrical radius of each compartment decreasing linearly from the compartment 48 at the top end 42 of each cushion to the compartment 50 at the bottom end 44 of each cushion.

It is preferred that each cushion be constructed from a pair of plastic sheets that are peripherally joined together to form an air pressurizing chamber of the desired peripheral dimensions, with a plurality of interior walls 52, formed by heat sealing the sheets together along preselected lines, dividing the air pressurizable chamber into adjacent compartments of the desired cylindrical configuration, each compartment to be in side-by-side relationship and each to be in fluid communication with the other by means of openings in the interior walls 54, representing places along said preselected lines where said sheets were not heat sealed together, which openings will have the effect of delaying deflation of the cushion in the event of accidental rupture at any point in any compartments of each cushion. It is contemplated that cushion construction be accomplished by means currently utilized in the construction of common air mattresses and similar devices.

Referring to FIG. 5, peripheral dimensions of each cushion and the radius of the compartment 48 at the top end 42 of each cushion are to be selected so that when each individual cushion is fully inflated the result is a wedge shaped cushion extending upwardly at a constant angle of approximately 15 degrees. Cushions 14, 16, and 18 are identical in size and shape, with an identical number of interior chambers. Cushions 24, 26, 28, and 30 are identical in size and shape, with an identical number of interior chambers. Cushions 14, 16, and 18 are each to be of a length from the top end 42 to the bottom end 44 equal to at least the distance between the coccyx and the top of the head. Cushions 24, 26, 28, and 30 are each to be of a length from the top end 42 to the bottom end 44 equal to the distance between the coccyx and the popliteal fossa. Because the human body does not measure the same from the coccyx to the popliteal fossa as it does from the coccyx to the top of the head, the latter always being of greater measure, cushions 14, 16, and 18 will always have support surfaces of greater length than cushions 24, 26, 28, and 30.

Referring to FIG. 1, the back and head support 12 is shown comprised of three cushions, 14, 16, and 18, in a vertical stack, each fully inflated, and each individually extending upward at a constant angle of 15 degrees. In such combination, the back and head support 12 has a total upward angle equal to the sum of three individual cushion angles, which sum is 45 degrees. By fully deflating cushion 14 or 16 or 18 only, two cushions remaining fully inflated, the combined upward angle of the back and head support 12 may be reduced by approximately 15 degrees to a combined upward angle of approximately 30 degrees. By partially inflating the deflated cushion, the total upward angle of the back and head support may be adjusted between approximately 30 degrees and 45 degrees.

Referring again to FIG. 1, the leg and foot support 20 is shown comprised of four cushions, 24, 26, 28, and 30 each at full inflation; cushions 24 and 26 being in a vertical stack resulting in a combined upward angle from line 32—32 of approximately 30 degrees; and cushions 28 and 30 being in a vertical stack resulting in a combined upward angle from line 34—34 of approximately 30 degrees. By partially deflating cushions 24 and 28 only in equal proportions from full inflation, cushions 26 and 30 remaining fully inflated, the combined upward angle from line 32—32 formed by cushions 24 and 26, and the upward angle from line 34—34 formed by cushions 28 and 30 may be reduced equally from approximately 30 degrees each to approximately 15 degrees each.

Figure 9:
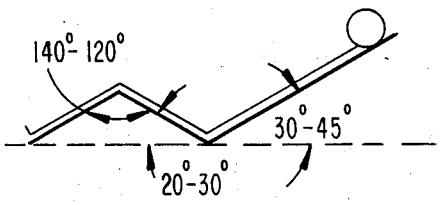
Fig. 9 PRIOR ART
FIG. 9 is a side view of the basic Fowler position, and is a Prior Art drawing.

It is intended that the recliner 10 shown in FIG. 1 be placed atop a convalescing patient's bed, which would place the base of the recliner 10 on a level support. If necessary, the recliner 10 may be secured in place by running tying means (straps) between cushions 14 and 16 that are secured to the bed, and by running tying means (straps) between cushions 28 and 30 that are secured to the bed. The patient would then recline upon the recliner 10 in the supine position, placing the patient's posterior atop line 32—32, resting the patient's back and the head upon the back and head support 12, the top of the head not extending beyond the midpoint of the upper-most chamber of cushion 18, and resting the patient's legs upon the leg and foot support 20, the popliteal fossa resting upon the upper-most chambers of cushions 24 and 28. Because the back and head support 12 and the leg and foot support 20 are interconnected together in the manner described, these two components will not change their relative positions even during the kinetics of sleep. The valley formed along the line 32—32 of interconnection will keep the convalescing patient's posterior from sliding downward, thereby maintaining the desired breaking point between the torso and legs even during periods of unconsciousness. The chambered construction of the cushions will tend to restrict longitudinal movement of the patient's body by folding up and around the patient on either side. The adjustments possible in the back and head support 12 to vary its total upward angle and the adjustments possible in the leg and foot support's upward angles from lines 32—32 and 34—34 permits an adjustment of the convalescent posture of the patient's back and head between the desirable upward angles of 30 and 45 degrees, and permits an adjustment of the convalescent posture of the patient's popliteal fossa for elevation through the desired angles of 120 degrees to 140 degrees, which corresponds to the desirable Fowler position in FIG. 9.

Figure 6:
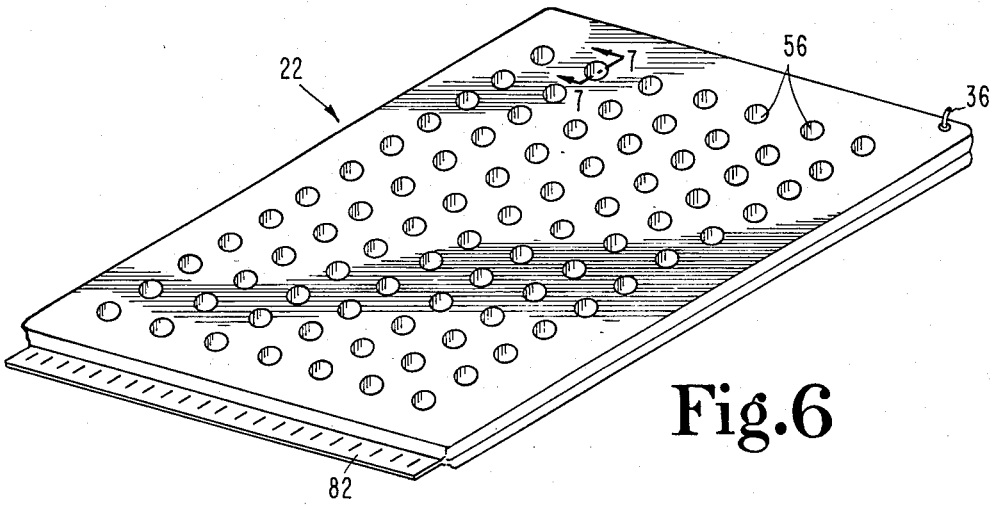
FIG. 6 is a perspective view of the inflatable heat dissipating cushion of FIG. 1.

Referring to FIGS. 1 and 6, there is shown an air inflatable support 22 to facilitate the dissipation of the convalescing patient's body heat. It is preferred that the cushions of the recliner 10 be constructed of a plastic material suitable for the construction of flexible pressurized air chambers. It is therefore contemplated that absent a device to help dissipate the convalescing patient's body heat, such heat would not be adequately dissipated through plastic material, rendering the recliner 10 uncomfortable for extended convalescent use. It is preferred that the air inflatable support 22 be constructed by the conventional plastic welding means previously described to form cushions 14, 16, and 18, from a pair of plastic sheets that are peripherally joined together to form an air pressurizable chamber of the desired peripheral dimensions, the length and width dimensions of which are such that the support 22 covers the support surface of cushion 18 shown in FIG. 1.

Figure 7:
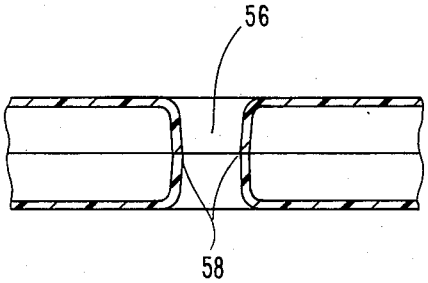
FIG. 7 is an enlarged cross-sectional view of the inflatable heat dissipating cushion of FIG. 6 taken along line 7—7 in the direction of the arrows.

Referring to FIGS. 6 and 7, there is shown a conventional air means 36 for inflating the air inflatable support 22. It is intended that the air inflatable support 22 have a plurality of holes 56 therethrough with the plastic sheets comprising the support 22 joined together around the circumference 58 of each hole 56.

Referring to FIG. 7, there is shown an enlarged cross-sectional view of the support 22 shown in FIG. 6, taken along line 7—7 in the direction of the arrows. Such construction will maintain the integrity of the support 22 as an air pressurizable chamber while allowing the convalescing patient's body heat to be dissipated through the holes 56 in the support 22 to be channelled along the crevasses 60 between the individual chambers of cushion 18 in FIG. 1.

Figure 3:
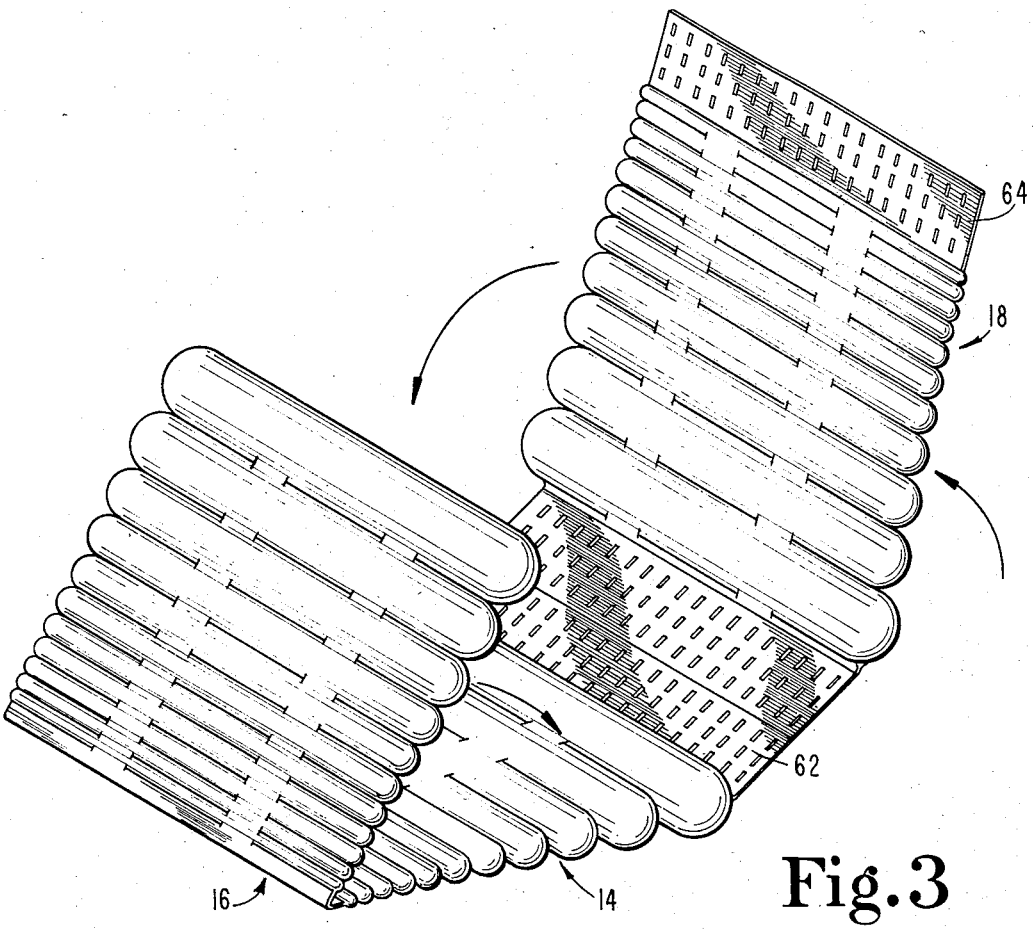
FIG. 3 is a perspective, unfolded view of individual cushions comprising the back and head support of FIG. 1.

Referring to FIG. 3, there is shown an unfolded view of the back and head support 12. It is intended that cushions 16, 14, connecting means 62, cushions 18, and connecting means 64 be constructed as one unit from a single pair of plastic sheets that are peripherally joined and welded by conventional plastic welding means in the manner previously described to form cushions 14, 16, and 18, such construction to be in the relationship shown in FIG. 3, and in the manner that will be described to form connecting means 62 and 64. When cushions 14, 16, and 18 are inflated, cushion 16 is folded over and upon cushion 14 to form a two-cushion vertical stack, and then cushion 18 is folded over and upon cushion 16 to form the three-cushion vertical stack that is the back and head support 12 shown in FIG. 1.

Figure 4:
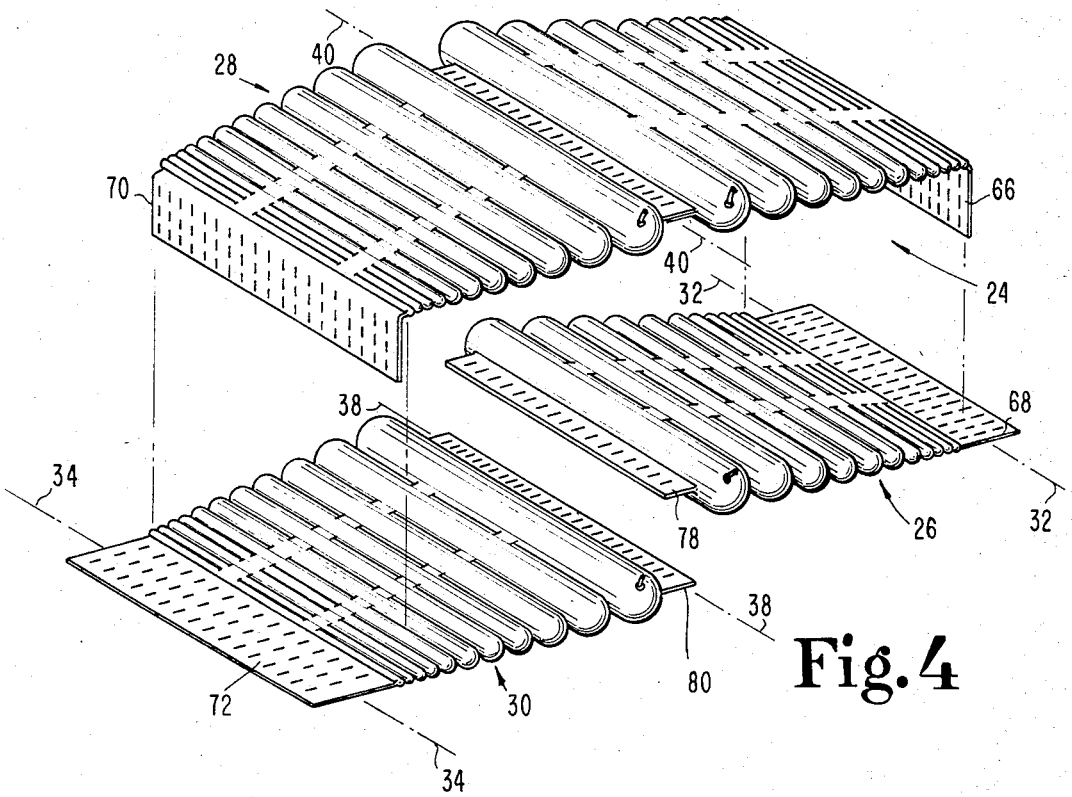
FIG. 4 is a perspective exploded view of the individual cushions that comprise the leg and foot support of FIG. 1 for elevation of the popliteal fossa through 120 degrees.

Referring to FIG. 4, there is shown a perspective exploded view of the individual cushions that comprise the leg and foot support 20, which is comprised of cushions 24, 26, 28, & 30. It is intended that individual cushions 24, 26, 28, and 30, each be constructed as a unit with their respective connecting means, described immediately below, each unit being constructed from a single pair of plastic sheets that are peripherally joined and welded by conventional plastic welding means in the manner previously described to form cushions 24, 26, 28 and 30, and in the manner that will be described to form their respective connecting means.

Cushions 24 and 28 are shown connected together along lines 40—40, utilizing connecting means attached thereto identical to connecting means 80 and 78 shown on cushions 30 and 26, respectively. Cushions 30 and 26 are intended to be connected together along line 38—38 utilizing connecting means 80 and 78. Cushions 30 and 28 are to be connected together along line 34—34 utilizing connecting means 72 and 70. Cushions 26 and 24 are to be connected together along line 32—32 utilizing connecting means 68 and 66. When cushions 24, 26, 28, and 30 are connected together in such fashion, they are collectively connected along line 32—32 to the back and head support 12 utilizing connecting means 68, 66, and 64.

Referring to FIGS. 6 and 1, support 22 is affixed to the recliner 10 along line 32—32 utilizing connecting means 82 in combination with connecting means 68, 66, and 64.

The preferred connecting means of the present invention is comprised of two plastic sheets fused together that are then perforated with a uniform and evenly spaced row or rows of rectangular-shaped slots, which row or rows run longitudinally with respect to the recliner 10. It has been found that two-inch intervals between slot perforations, and one-half inch slot widths is satisfactory for the preferred connecting means of the present invention. All preferred connecting means of the present invention are perforated and sized in such manner that when any two or more connecting means are positioned together in a vertical stack or stacks all perforations are identical in position and size with the corresponding perforations of connecting means in side by side relationship.

Figure 2:
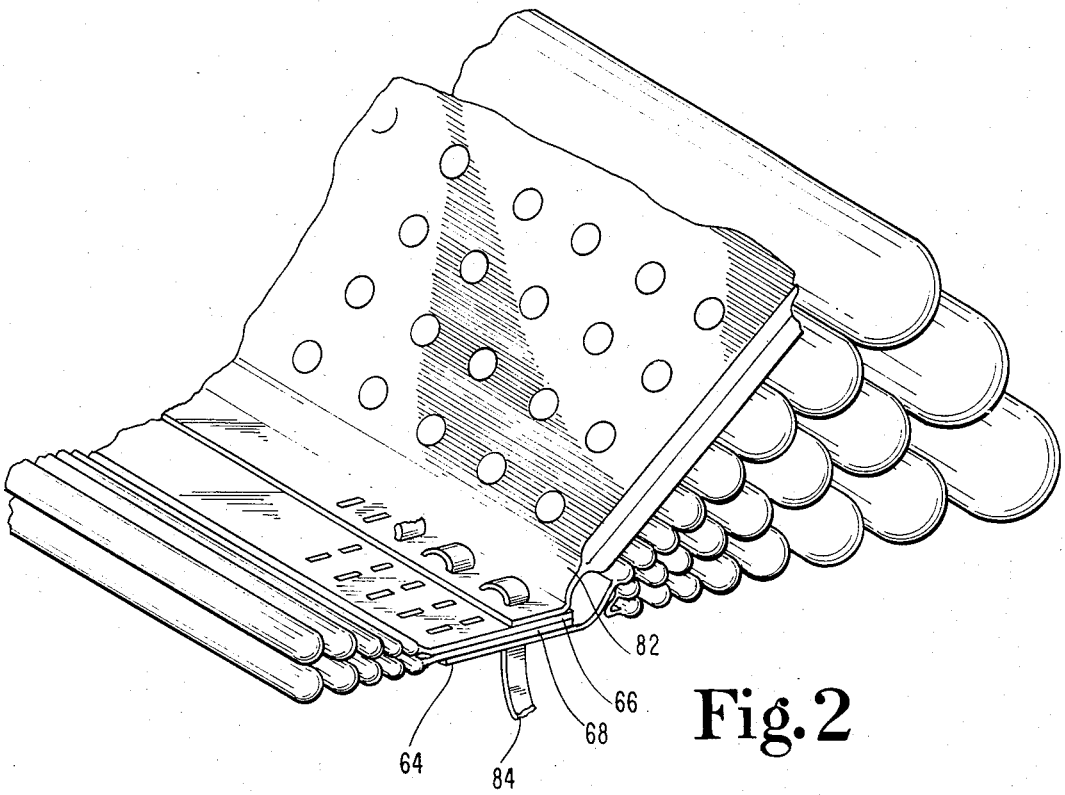
FIG. 2 is an enlarged, fragmentary, perspective view of the interconnecting means that interconnect the back and head support, the heat dissipating cushion, and the leg and foot support of FIG. 1.

Referring to FIG. 2, all connecting means are removably interconnectable together by a flexible tie or strip 84 that extends weavingly through the perforations of all connecting means in side by side relationship, as are connecting means 64, 66, 68, and 82 in FIG. 2.

Referring to FIGS. 3 and 4, connecting means 64, 66, 68, 72, and 70 are each comprised of three uniform and evenly spaced rows of perforated rectangular-shaped slots, which rows run longitudinally with respect to the recliner 10. Three rows of slots on connecting means 64, 66 and 68 permits the patient to adjust the spacing between the back and head support 12 and the leg and foot support 20 along line 32—32 to the size of the patient's posterior, by selectively aligning rows of slots of these connecting means before they are interconnected together with a flexible tie or strip 84. Connecting means 78 and 80 shown on cushions 26 and 30, respectively, in FIG. 4, as well as identical corresponding connecting means on cushions 24 and 28 located along line 40—40 in FIG. 4, as well as connecting means 82 on the support 22, in FIG. 6, are each comprised of one uniform and evenly spaced row of perforated rectangular-shaped slots, which row runs longitudinally with respect to the recliner 10. It is not contemplated that the components of the present invention to which these connecting means are attached will need to be adjustable along the lines of interconnection between them.

Referring to FIG. 3, connecting means 62 is similarly constructed to the foregoing connecting means, but contains a sufficient number of the uniform and evenly spaced rows of perforated, rectangular-shaped slots, which rows run longitudinally with respect to the recliner 10, to give connecting means 62 a horizontal dimension large enough to span the largest compartments of cushions 14, 16 and 18 in FIG. 1 when these cushions are at full inflation. Perforated, rectangular-shaped slots are provided on connecting means 62 to permit future connection of other therapeutic components utilizing the same connecting means as the present invention.

Alternative connecting means could be utilized. That shown and described as the preferred embodiment is selected for its ease of manufacture, resulting lower cost, and ease of use. Other connecting means, such as hook and loop type fastener, such as the ones sold under the TRADEMARK of VELCRO, as an example, may be utilized, but at additional cost, it is believed.

Figure 8:
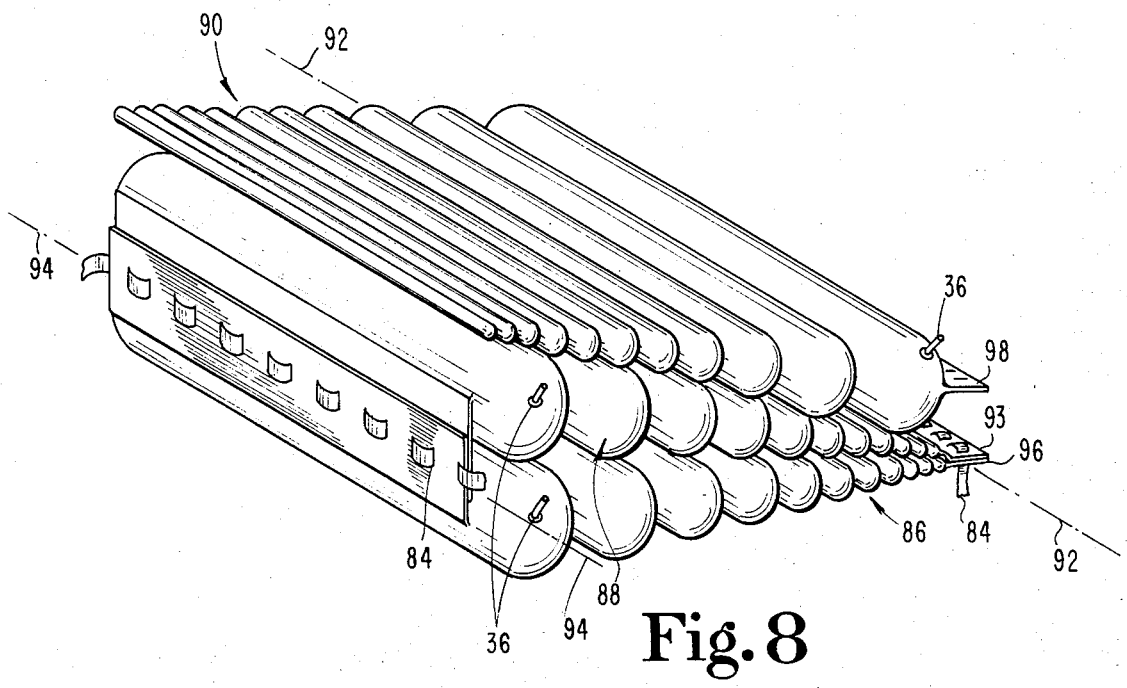
FIG. 8 is a perspective view of individual wedge shaped, air inflatable, cushions of the present invention interconnected together so as to provide the means to elevate the popliteal fossa through 150 degrees when incorporated into the leg and foot support in FIG. 1.
Figure 10:
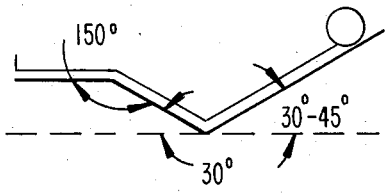
Fig. 10 PRIOR ART
FIG. 10 is a side view of the modified Fowler position, and is a Prior Art drawing.

Referring to FIG. 8, there is shown three individual wedge shaped, air inflatable, cushions 86, 88, and 90, in a vertical stack, which individual cushions are of identical size, shape, and construction as cushions 24, 26, 28, and 30 comprising the leg and foot support 20, with the exception that the connecting means of cushions 88 and 86 adjacent to line 94—94 in FIG. 8 are each comprised of not one but two uniformly and evenly spaced rows of perforated rectangular-shaped slots, which rows run longitudinally with respect to the recliner 10. Cushions 88 and 86 are interconnected along line 94—94 by aligning rows of perforated rectangular-shaped slots in the connecting means of each cushion in side by side relationship and interconnecting these together along said line by a flexible tie or strip 84 that extends weavingly through the perforations of these connecting means. The connecting means 93, and 96 of cushions 88 and 86 along line 92—92 are interconnected together correspondingly. Cushion 90 has no connecting means at the end adjacent to line 94—94, but has a connecting means 98 adjacent to line 92—92 comprised of one row of uniform and evenly spaced perforated rectangular-shaped slots, which row runs longitudinally with respect to the recliner 10. When interconnected and stacked together as shown in FIG. 8, cushions 86, 88, and 90 may be added to the leg and foot support 20 in FIG. 1 to replace cushion 28 by interconnecting the connecting means 98 of cushion 90 with the connecting means of cushion 24 along line 40—40. When cushions 86, 88, and 90 are so added to the recliner 10, all cushions being at full inflation, a convalescing patient's popliteal fossa may be elevated through the desired angle of approximately 150 degrees, which corresponds to the modified Fowler position depicted in FIG. 10.

In another embodiment of the present invention, in place of the plurality of individual wedge shaped cushions interconnected together in vertical stacks as in the preferred embodiment, there are a plurality of individually shaped, air inflatable cushions positioned and interconnected together so that they each would extend longitudinally across the width of a person supported thereon, which are varyingly sized so that together they define a wedge shaped back and head support extending upwardly at an angle between 30 degrees and 45 degrees with a support surface equal to at least the distance between the coccyx and the top of the head; and there are a plurality of individually shaped, air inflatable cushions positioned and interconnected together so that they each would extend longitudinally across the width of a person supported thereon, which are also varyingly sized so that together they define a leg and foot support extending upwardly at a first angle between 20 degrees and 30 degrees and for elevation of the popliteal fossa through a second angle between at least 120 degrees and 140 degrees, with a support surface for the portion of the body between the coccyx and the popliteal fossa equal to the distance between the coccyx and the popliteal fossa and with a support surface for the portion of the body between the popliteal foss and the feet equal in length to at least the length of the support surface for the portion of the body between the coccyx and the popliteal fossa; with connecting means of the preferred embodiment interconnecting the back and head support and the leg and foot support together.

In another embodiment of the present invention, in place of the plurality of individual wedge shaped cushions as in the preferred embodiment, there are singularly chambered, air inflatable cushions that define a back and head support extending upwardly at an angle between 30 degrees and 45 degrees with a support surface equal to at least the distance between the coccyx and the top of the head, and there are singularly chambered, air inflatable cushions that define a leg and foot support extending upwardly at a first angle between 20 degrees and 30 degrees and for elevation of the popliteal fossa through a second angle between at least 120 degrees and 140 degrees, with a support surface for the portion of the body between the coccyx and the popliteal fossa equal to the distance between the coccyx and the popliteal fossa and with a support surface for the portion of the body between the popliteal fossa and the feet equal in length to at least the length of the support surface for the portion of the body between the coccyx and the popliteal fossa; with connecting means of the preferred embodiment interconnecting the back and head support and the leg and foot support together.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A portable recliner for supporting a person in a supine position adapted to be positioned on a bed, comprising:

a substantially triangular back and head support extending upwardly at an angle between 30 degrees and 45 degrees and including a plurality of individual wedge shaped, air inflatable, cushions with a support surface of a first length equal to at least the distance between the coccyx and the top of the head and positioned and interconnected together in a vertical stack;

a substantially triangular leg and foot support extending from an edge area adjacent the back and head support upwardly at a first angle between 20 degrees and 30 degrees for elevation of the popliteal fossa through a second angle between 120 degrees and 150 degrees and including a plurality of individual wedge shaped, air inflatable, cushions with a support surface of a second length equal to the distance between the coccyx and the popliteal fossa and positioned and interconnected together in vertical stacks;

a valve on said cushions operable to allow inflation of each at a desired internal air pressure to determine said angles;

connecting means interconnecting said back and head support and said leg and foot support together, and including connecting means interconnecting said cushions of said leg and foot support together.

2. The recliner of claim 1 wherein:

said cushions of said leg and foot support are separable and removably interconnected together.

3. The recliner of claim 1 wherein:

said cushions each include a bottom end, a top end and a pair of plastic sheets peripherally joined together forming an air pressurizable chamber, each of said cushions further include a plurality of interior walls dividing said chamber into a plurality of individual air compartments in fluid communication together with said interior walls delaying the deflation of said compartments in the event of accidental rupture of any one compartment, said compartments differing in size and arranged in order so said compartments increase in size from said bottom end to said top end, each of said cushions of a first length of said back and head support being identical in size and construction including having the identical number and sizes of compartments and each of said cushions of a second length of said leg and foot support being identical in size and construction including having the identical number and sizes of compartments.

4. The recliner of claim 3 wherein:

said compartments are cylindrical with spherical caps in their configuration and are of constant cylindrical radius each cylindrical compartment extending longitudinally across the width of a person supported thereon.

5. The recliner of claim 3 wherein said connecting means are connected to said top ends and to said bottom ends of said cushions.

6. A portable recliner for supporting a person in a supine position, adapted to be positioned on a bed, comprising:

a substantially triangular back and head support extending upwardly at an angle between 30 degrees and 45 degrees and including a plurality of individual wedge shaped, air inflatable, cushions with a support surface of a first length equal to at least the distance between the coccyx and the top of the head and positioned and interconnected together in a vertical stack;

a substantially triangular leg and foot support extending from an edge area adjacent the back and head support upwardly at a first angle between 20 degrees and 30 degrees for elevation of the popliteal fossa through a second angle between 120 degrees and 150 degrees and including a plurality of individual wedge shaped, air inflatable, cushions with a support surface of a second length equal to the distance between the coccyx and the popliteal fossa and positioned and interconnected together in vertical stacks;

a valve on said cushions operable to allow inflation of each at a desired internal air pressure to determine said angles;

an air inflatable support for dissipating heat from a person positioned thereatop, including a pair of plastic sheets joined together forming an air pressurizable chamber therebetween, said sheets having a plurality of aligned holes extending therethrough with said sheets being joined together around the circumference of each hole allowing heat flow through said sheets from said person but limiting air flow from said chamber into each hole providing an insulated cushion for said person laying thereatop; and, connecting means interconnecting said back and head support and said leg and foot support and said support for dissipating heat together, including connecting means interconnecting said cushions of said leg and foot support together.

7. The support of claim 6 wherein:

said cushions each include a bottom end, a top end and a pair of plastic sheets peripherally joined together forming an air pressurizable chamber, each of said cushions further include a plurality of interior walls dividing said chamber into a plurality of individual air compartments in fluid communication together with said interior walls delaying the deflation of said compartments in the event of accidental rupture of any one compartment, said compartments differing in size and arranged in order so said compartments increase in size from said bottom to said top end.

8. A portable recliner for supporting a person in a supine position, adapted to be positioned on a bed, comprising:

a substantially triangular back and head support extending upwardly at an angle between 30 degrees and 45 degrees and including a plurality of individual wedge shaped, air inflatable, cushions with a support surface of a first length equal to at least the distance between the coccyx and the top of the head and positioned and interconnected together in a vertical stack;

a substantially triangular leg and foot support extending from an edge area adjacent the back and head support upwardly at a first angle between 20 degrees and 30 degrees for elevation of the popliteal fossa through a second angle between 120 degrees and 150 degrees and including a plurality of individual wedge shaped, air inflatable, cushions with a support surface of a second length equal to the distance between the coccyx and the popliteal fossa and positioned and interconnected together in vertical stacks;

a valve on said cushions operable to allow inflation of each at a desired internal air pressure to determine said angles;

connecting means interconnecting said back and head support and said leg and foot support together, and including connecting means interconnecting said cushions of said leg and foot support together;

said cushions each include a bottom end, a top end and a pair of plastic sheets peripherally joined together forming an air pressurizable chamber, each of said cushions further include a plurality of interior walls dividing said chamber into a plurality of individual air compartments in fluid communication together with said interior walls delaying the deflation of said compartments in the event of accidental rupture of any one compartment, said compartments differing in size and arranged in order so said compartments increase in size from said bottom end to said top end; and each of said cushions of a first length of said back and head support is identical in size and construction including having the identical number and sizes of compartments.

9. A portable recliner for supporting a person in a supine position, adapted to be positioned on a bed, comprising:

a substantially triangular back and head support extending upwardly at an angle between 30 degrees and 45 degrees and including a plurality of individual wedge shaped, air inflatable, cushions with a support surface of a first length equal to at least the distance between the coccyx and the top of the head and positioned and interconnected together in a vertical stack;

a substantially triangular leg and foot support extending from an edge area adjacent the back and head support upwardly at a first angle between 20 degrees and 30 degrees for elevation of the popliteal fossa through a second angle between 120 degrees and 150 degrees and including a plurality of individual wedge shaped, air inflatable, cushions with a support surface of a second length equal to the distance between the coccyx and the popliteal fossa and positioned and interconnected together in vertical stacks;

a valve on said cushions operable to allow inflation of each at a desired internal air pressure to determine said angles;

connecting means interconnecting said back and head support and said leg and foot support together, and including connecting means interconnecting said cushions of said leg and foot support together;

said cushions each include a bottom end, a top end and a pair of plastic sheets peripherally joined together forming an air pressurizable chamber, each of said cushions further include a plurality of interior walls dividing said chamber into a plurality of individual air compartments in fluid communication together with said interior walls delaying the deflation of said compartments in the event of accidental rupture of any one compartment, said compartments differing in size and arranged in order so said compartments increase in size from said bottom end to said top end; and each of said cushions of a second length of said leg and foot support is identical in size and construction including having the identical number and sizes of compartments.

10. A portable recliner for supporting a person in a supine position adapted to be positioned on a bed, comprising:

a substantially triangular back and head support extending upwardly at an angle between 30 degrees and 45 degrees and including a plurality of individual wedge shaped, air inflatable, cushions with a support surface of a first length equal to at least the distance between the coccyx and the top of the head and positioned and interconnected together in a vertical stack;

a substantially triangular leg and foot support extending from an edge area adjacent the back and head support upwardly at a first angle between 20 degrees and 30 degrees for elevation of the popliteal fossa through a second angle between 120 degrees and 150 degrees and including a plurality of individual wedge shaped, air inflatable, cushions with a support surface of a second length equal to the distance between the coccyx and the popliteal fossa and positioned and interconnected together in vertical stacks;

a valve on said cushions operable to allow inflation of each at a desired internal air pressure to determine said angles;

connecting means interconnecting said back and head support and said leg and foot support together and, including connecting means interconnecting said cushions of said leg and foot support together;

said cushions each include a bottom end, a top end and a pair of plastic sheets peripherally joined together forming an air pressurizable chamber, each of said cushions further include a plurality of interior walls dividing said chamber into a plurality of individual air compartments in fluid communication together with said interior walls delaying the deflation of said compartments in the event of accidental rupture of any one compartment, said compartments differing in size and arranged in order so said compartments increase in size from said bottom end to said top end; and said compartments are cylindrical with spherical caps in their configuration and are of constant cylindrical radius each cylindrical compartment extending longitudinally across the width of a person supported thereon.

11. A portable recliner for supporting a person in a supine position, adapted to be positioned on a bed, comprising:

a substantially triangular back and head support extending upwardly at an angle between 30 degrees and 45 degrees and including a plurality of individual wedge shaped, air inflatable, cushions with a support surface of a first length equal to at least the distance between the coccyx and the top of the head and positioned and interconnected together in a vertical stack;

a substantially triangular leg and foot support extending from an edge area adjacent the back and head support upwardly at a first angle between 20 degrees and 30 degrees and for elevation of the popliteal fossa through a second angle between 120 degrees and 150 degrees and including a plurality of individual wedge shaped, air inflatable, cushions with a support surface of a second length equal to the distance between the coccyx and the popliteal fossa and positioned and interconnected together in vertical stacks;

a valve on said cushions operable to allow inflation of each at a desired internal air pressure to determine said angles;

connecting means interconnecting said back and head support and said leg and foot support together and, including connecting arms interconnecting said cushions of said leg and foot support together;

said cushions each include a bottom end, a top end and a pair of plastic sheets peripherally joined together forming an air pressurizable chamber, each of said cushions further include a plurality of interior walls dividing said chamber into a plurality of individual air compartments in fluid communication together with said interior walls delaying the deflation of said compartments in the event of accidental rupture of any one compartment, said compartments differing in size and arranged in order so said compartments increase in size from said bottom end to said top end;

said connecting means includes a first perforated member attached to an end of one of said cushions running longitudinally with said end and further including a second perforated member attached to an end of a second of said cushions and a flexible tie extending weavingly through said first perforated member and said second perforated member removably connecting same together; and said connecting means being connected to said top ends and to said bottom ends of said cushions.

* * * * *